US009057159B2

(12) United States Patent
Honnorat

(10) Patent No.: US 9,057,159 B2
(45) Date of Patent: Jun. 16, 2015

(54) PAPER THAT CANNOT BE FORGED USING SOLVENTS

(71) Applicant: Honnorat Recherches & Services, Annecy (FR)

(72) Inventor: Andre Honnorat, Annecy (FR)

(73) Assignee: Honnorat Recherches & Services, Annecy (FR)

( * ) Notice: Subject to any disclaimer, the term of this patent is extended or adjusted under 35 U.S.C. 154(b) by 0 days.

(21) Appl. No.: 13/945,507

(22) Filed: Jul. 18, 2013

(65) Prior Publication Data

US 2014/0027078 A1 Jan. 30, 2014

Related U.S. Application Data

(63) Continuation-in-part of application No. PCT/FR2011/000630, filed on Dec. 1, 2011.

(51) Int. Cl.

| | |
|---|---|
| ***D21H 17/26*** | (2006.01) |
| ***D21H 17/69*** | (2006.01) |
| ***D21H 21/14*** | (2006.01) |
| ***D21H 21/28*** | (2006.01) |
| ***D21H 21/52*** | (2006.01) |
| ***D21H 23/04*** | (2006.01) |
| ***D21H 21/40*** | (2006.01) |
| ***D21H 17/70*** | (2006.01) |
| ***D21H 21/46*** | (2006.01) |

(52) U.S. Cl.

CPC ..... *D21H 21/40* (2013.01); *D21H 17/26* (2013.01); *D21H 17/69* (2013.01); *D21H 17/70* (2013.01); *D21H 21/28* (2013.01); *D21H 21/285* (2013.01); *D21H 21/46* (2013.01)

(58) Field of Classification Search

USPC ..... 162/140, 158, 175, 177, 181.1–181.9; 283/72, 95, 96, 114; 428/32.15, 428/32.24–32.27, 32.5, 221, 323, 357, 428/330–332, 402, 916, 917; 106/400–506

See application file for complete search history.

(56) References Cited

U.S. PATENT DOCUMENTS

| | | | | |
|---|---|---|---|---|
| 322,130 | A | 7/1885 | Schreiber | |
| 643,084 | A | 2/1900 | Colgrove | |
| 4,478,681 | A | 10/1984 | Müller et al. | |
| 4,863,783 | A | 9/1989 | Milton | |
| 5,123,999 | A | 6/1992 | Honnorat | |
| 6,663,960 | B1 * | 12/2003 | Murakami et al. | 428/402 |
| 7,041,364 | B2 | 5/2006 | Rancien | |

FOREIGN PATENT DOCUMENTS

| | | |
|---|---|---|
| EP | 0 174 885 | 3/1986 |
| EP | 0 190 087 | 8/1986 |
| EP | 0 219 713 | 4/1987 |
| EP | 0 226 367 | 6/1987 |
| EP | 0 378 029 | 7/1990 |
| EP | 0 494 828 | 7/1992 |
| EP | 0 632 162 | 1/1995 |
| EP | 1 074 599 | 2/2001 |
| EP | 1 342 768 | 9/2003 |
| FR | 2478695 A * | 9/1981 |
| FR | 2 650 606 | 2/1991 |
| JP | 2000303388 | 10/2000 |

OTHER PUBLICATIONS

Machine translation of FR 2478695, The European Patent Office, [online], [retrieved on Sep. 10, 2014]. Retrieved from the Internet: <URL: http://worldwide.espacenet.com/publicationDetails/description?CC=FR&NR=2478695A1&KC=A1&FT=D&ND=3&date=19810925&DB=worldwide.espacenet.com&locale=en_EP>.*

* cited by examiner

*Primary Examiner* — Dennis Cordray

(74) *Attorney, Agent, or Firm* — Vedder Price P.C.; Thomas J. Kowalski; Deborah L. Lu

(57) ABSTRACT

The present invention relates to a security paper that cannot be forged with respect to forgery attempts with non-aqueous solvents, characterized in that it comprises on its surface and/or in its bulk, clusters formed of elementary particles that are both insoluble in water and in solvents, amalgamated with an agglomerating agent that is also insoluble in water but almost instantaneously soluble in at least one non-aqueous solvent so as to release said elementary particles in the paper, which elementary particles are preferably less than 20 μm, and more preferably still less than 10 μm, they are colored and are advantageously intense pigment dyestuffs such as those used for producing inks or paints.

17 Claims, No Drawings

PAPER THAT CANNOT BE FORGED USING SOLVENTS

CROSS REFERENCE TO RELATED APPLICATIONS

This application is a continuation-in-part of International Patent Application No. PCT/FR2011/000630 filed Dec. 1, 2011, published as WO2012/101334, and claiming priority to FR 1100211 filed Jan. 25, 2011. All of the above-mentioned applications, as well as all documents cited herein and documents referenced or cited in the documents cited herein, are hereby incorporated herein in their entirety by reference.

FIELD OF THE INVENTION

The invention is directed to security paper that cannot be forged with respect to forgery attempts with non-aqueous solvents.

BACKGROUND OF THE INVENTION

Documents such as cheques, vouchers, passports, certain gift vouchers, identity documents and various papers such as medical prescriptions, title deeds and various civil status documents contain personal information susceptible to alteration by forgers.

The alterations consist of using erasing agents to remove the variable data on the documents and affixing new information, for example a new recipient or a different amount on a cheque.

The erasing agents used by forgers are all those likely to be found commercially; in particular bleach, acids, bases, oxidation-reduction combinations, solvents are used and, very generally, all products capable of erasing inks such as for example hair sprays, white spirit, brake fluid, liquid stain removers, etc.

Among the known products that cannot be forged, there may be mentioned in particular those described in patent FR 2 650 606 which make it possible to treat papers with respect to bases, eraser pencils and alkaline reducing agents or patent EP 190 087 which more specifically indicates reagents for eraser pencils. Document EP 494 828 indicates a reaction for unforgeability with respect to sodium sulphite. Documents U.S. Pat. No. 4,478,681, EP 174 885, EP 378 029 or EP 632 162 indicate reagents with respect to oxidation-reduction combinations and papers that cannot be forged treated in this way. Reagents with respect to acids have been known for a very long time, for example from U.S. Pat. No. 322,130 dated 14 Jul. 1885 or U.S. Pat. No. 643,084 from 1900.

Reactions for unforgeability with respect to solvents have been known in security papers for several years according to different operating methods:

- Operation by printing coloured inks containing dyestuffs that are soluble in solvents which stain the paper during an attempt to erase the inks, these dyestuffs are generally introduced into a security background printed in microtext or into a background image on the parts intended to be written on by hand. The process of treating the papers according to this operating method is a printing process.
- Operation by solubilization of dyestuffs that are not soluble in water but are soluble in solvents, these so-called "organo-soluble" dyestuffs being finely dispersed in the bulk of the paper, the particles being typically less than 20 μm. The process of treating papers according to this operating method is a papermaking process, the particles being introduced into the paper pulp before the production of the sheet and therefore distributed over its volume.

SUMMARY OF THE INVENTION

Provided is a security paper that cannot be forged with respect to forgery attempts with non-aqueous solvents, comprising on its surface and/or in its bulk, clusters formed of elementary particles amalgamated with an agglomerating agent that is insoluble in water but almost instantaneously soluble in at least one non-aqueous solvent, which agglomerating agent is present in a maximum proportion of 40% by dry weight in the clusters, said elementary particles are coloured pigments and are advantageously intense pigment dyestuffs such as those used for producing inks or paints, said elementary particles are insoluble both in water and in non-aqueous solvents and have sizes of less than 20 μm, and advantageously less than 10 μm.

Also provided is a process for making a paper unforgeable with respect to non-aqueous polar and/or non-polar solvents characterized in that clusters with sizes of less than 500 μm formed of elementary particles with reduced sizes that are insoluble both in water and in non-aqueous solvents, of less than 20 μm, and advantageously less than 10 μm, amalgamated with an agglomerating agent from the family of ethyl celluloses likewise insoluble in water but almost instantaneously soluble in at least one non-aqueous solvent, which agglomerating agent is present in a maximum proportion of 40% by dry weight in the clusters, which elementary particles are coloured pigments and are advantageously intense pigment dyestuffs such as those used for producing inks or paints, are introduced into the paper pulp, before production of the sheet.

DETAILED DESCRIPTION

Because the paper that cannot be forged according to the invention is produced principally by papermaking route, the technique known today and its limitations should be described in more detail.

Treatment with respect to solvents using organo-soluble dyestuffs has been known for several years and is described in particular on page 6 of patent FR 2 650 606 or on page 4 of document EP 190 087, as well as on page 1 of document U.S. Pat. No. 7,041,364.

The concept of unforgeability in the current treatment is based on the introduction of organo-soluble dyestuffs into the whole of the sheet in a finely dispersed manner, such that the individual dyestuff particles are imperceptible to the eye and do not colour the paper, because, while they are insoluble in water, these dyestuffs solubilize under the action of erasing agents containing solvents, producing a stain that is perceptible to the eye. During the solubilization of the particles present in the paper the dyestuff diffuses into the fibrous network and covers a larger surface area than that of the individual particles, thus developing a stain.

The treatment with respect to solvents used today by papermakers requires two types of organo-soluble dyestuffs, a dyestuff that is soluble in polar solvents and a dyestuff that is soluble in non-polar solvents, so as to cover the whole range of solvents and commercial products containing solvents likely to be used by forgers. The definitions of non-aqueous polar and non-polar solvents are given in particular in U.S. Pat. No. 7,041,364.

This treatment of papers is very suitable when the paper is surface-protected by a security film which hampers forgers, but in the case of papers that are not surface-protected, for example cheques, tickets and the vast majority of security papers, forgers have effectively countered this treatment by producing a chemical erasure of the paper by soaking or by a successive application of the solvents so as to completely extract the dyestuffs from the paper.

This forgery technique presents a formidable challenge and is driving papermakers to introduce large quantities of organo-soluble dyestuffs into the sheet, resulting in the problems of a loss of whiteness of the paper and significant extra costs.

The current solution for protecting papers is no longer a suitable response with respect to the problem posed by forgers.

The objective of the invention is therefore to treat the paper such that the solvents applied by forgers lead to a staining of the paper which is definitive and irreversible.

Thus, the security paper that cannot be forged with respect to forgery attempts with non-aqueous solvents according to the invention is characterized in that it comprises on its surface and/or in its bulk, clusters formed of elementary particles amalgamated with an agglomerating agent that is insoluble in water but almost instantaneously soluble in at least one non-aqueous solvent, which elementary particles are insoluble both in water and in solvents and preferably have sizes of less than 20 μm, and more preferably still less than 10 μm, they are coloured and are advantageously intense pigment dyestuffs such as those used for producing inks or paints.

The operating principle of the staining developed by the solvents in the paper that cannot be forged according to the invention is as follows: the clusters distributed over the whole of the volume of the sheet are broken up by the presence of the solvent and the coloured pigment particles are dispersed around the position of each cluster, producing a coloured spot, the dispersion of the particles takes place in an irreversible manner by diffusion into the interstices of the fibrous network in a manner limited to the immediate vicinity of the cluster.

Thus, instead of the known process of solubilization of the organo-soluble dyestuffs to bring about the stain, a process of solubilization of an agglomerating agent and release of insoluble coloured particles is proposed.

Because the elementary particles are insoluble in solvents, said particles will remain trapped in the fibrous network, in the same way as the mineral fillers introduced into the paper. Once the agglomerating agent has been eliminated, the particles cannot be extracted by multiple washing with solvents and the stain remains fixed in the paper as an indication of the forgery.

It is important to note that the clusters as described differ from the particles or granules conventionally introduced into papers for the purposes of authentication, such as those described in patents EP 219 713, EP 226 367, EP 1 074 599, EP 1 342 768 or JP2000303388, by the fact that the agglomerating agent is almost instantaneously soluble in solvents, also on account of the choice of said agent, as well as by the choice of the particles incorporated, as well as likewise, for some of the patents mentioned, by the fact that the coloured pigment particles are distributed over the whole of the volume of the cluster and not only on its surface. Moreover, it is important to note that the known clusters that can be used for the purposes of authentication comprise binders that are cross-linked under the action of heat during the drying of the paper, which makes them insoluble in solvents in the context of the invention and according to the definition of solubility indicated below in this description. In all cases the known agglomerates are unsuitable for releasing the particles contained in the clusters in a time that is acceptable for the development of any stain, which is usually not possible because the particles in question are intended to be invisible in daylight and luminescent for the authentication of the paper.

Authentication and unforgeability of papers are two different fields, even if reactions for unforgeability have been used for the purposes of authentication, the first field being aimed at providing the proof that a document is authentic, or original, the second being aimed at preventing the alteration of the variable data affixed to the documents, the reagents that cannot be forged having the aim of producing a stain that is visible, generally without equipment, during an attempt at fraud.

No description of particles amalgamated in the form of clusters with large sizes for the purposes of unforgeability has been found in the literature.

The advantages of the security paper that cannot be forged according to the invention are numerous:

- the coloured pigment particles are insoluble in solvents, which makes it possible to avoid the phenomenon of chemical erasure of the paper and loss of unforgeability, thus the security of the papers is therefore reinforced,
- there are currently very few commercially available organo-soluble dyestuffs that can be used, these dyestuffs are known essentially in two or three colours, the use of clusters according to the invention allows the use of very varied pigment dyestuffs, in particular red, violet, pink, green, or yellow dyestuffs, and therefore colour reactions very different from what is possible today,
- the treatment used today requires two dyestuffs for the polar and non-polar solvents, it has been discovered that with a judiciously chosen agglomerating agent a single type of pigment particles can develop stains with polar and non-polar solvents, and the commercial products containing solvents, which simplifies the treatment, it is very obviously possible, and this is included within the scope of the invention, to use agglomerating agents that are sensitive only to polar solvents or only to non-polar solvents,
- the elementary pigments used in the clusters can be very varied because the criteria of insolubility, both in solvents and in water, are frequently met, it is thus possible to use very cheap products such as carbon black or inexpensive dyestuffs to replace the more expensive organo-soluble dyestuffs, which represents a certain economic advantage taking into account the tonnage of paper made with these products worldwide.

Other features and advantages of the invention will become apparent from the description that follows.

The invention relates to a paper treated in its bulk or on its surface in order to be unforgeable with respect to solvents, which comprises clusters formed of elementary particles, which particles are insoluble both in water and in solvents. The clusters in the context of the invention are agglomerates of pigment particles with a binding agent, the particles with small sizes, advantageously less than 20 μm, are distributed over the whole of the volume of the cluster more or less homogeneously, the cement between the particles being the agglomerating agent.

The clusters can be obtained in different ways, according to several physical processes of agglomeration, for example it can be envisaged to produce clusters by solubilization of a wax in a solvent, dispersion of the pigment particles in the wax, production of an emulsion in water and precipitation of the clusters, it can also be envisaged to incorporate an agglomeration additive during the manufacture of the pigment particles themselves so as to produce pigment aggregates intended to then be ground to the desired dimension, or various other techniques can be used that make it possible to form agglomerates of particles with a binder.

The processes making it possible to obtain the agglomerates are not limitative, advantageously economical techniques that make it possible to obtain clusters as close as possible to the desired grain sizes will be preferred.

The elementary pigment particles have sizes developed in standard manner for producing inks and paints, i.e. particle sizes of preferably less than 20 μm, and more preferably still less than 10 μm, sizes of less than 1 μm usually being found in dyestuffs and coloured pigments. Pigment particles comprising a high colouring power such as for example carbon black, phthalocyanine derivatives such as Pigment Blue 15:3, or the pigments defined by the products of the Colour Index Pigment Yellow 93 or Pigment Yellow 83 will advantageously be chosen in the clusters.

In the context of the invention the clusters preferably have sizes of less than 500 μm and more preferably still sizes of less than 200 μm, advantageously the clusters are greater than 20 μm and more preferably still greater than 50 μm.

The choice of the maximum size of the clusters is linked on the one hand to the desired effect and on the other hand to the category of elementary pigment particles used. If carbon black is used the clusters will advantageously be small in size, so as not to be very visible to the eye, i.e. typically less than 100 μm and more preferably still less than 70 μm. In the case of yellow or red pigment particles the sizes will be able to be larger and to range up to, for example, 300 μm, so as to optionally provide a means of showing that the paper has been treated or to provide a background tint effect on the paper if the quantity of clusters is very great.

The minimum size of the clusters must be greater than 20 μm in order that there is no staining of the paper.

According to the invention the clusters are constituted by particles that are insoluble in water and in all types of solvents amalgamated by an agglomerating agent likewise insoluble in water but almost instantaneously soluble in at least one non-aqueous solvent so as to release said elementary particles in the paper.

By almost instantaneously soluble is meant that when a drop of a solvent is deposited on the paper a stain appears almost instantaneously, and at the latest before the solvent is evaporated. This represents a fraction of a second for solvents such as ethanol or acetone, or a few seconds for solvents of low volatility or commercial liquids containing a reduced proportion of solvent in their composition.

By comparison, binders comprising latex or polymerized resins do not solubilize in any way under the same conditions and therefore cannot be used as agglomerating agent in the context of the invention. Such binders generally are not solubilized by an operation of soaking the paper such as can be practised by forgers.

The agglomerating agent is chosen very precisely in order to be able to solubilize very rapidly in solvents, according to the invention the agglomerating agent is soluble in polar solvents such as for example alcohol or acetone, for this it can be envisaged to use a product such as ethyl cellulose as agglomerating agent, in a small proportion relative to the elementary particles.

According to the invention the agglomerating agent is soluble in non-polar solvents such as for example toluene or hydrocarbons, with this option it can be envisaged to use a vinyl copolymer resin as agglomerating agent. However, with this option the agglomerating agent is practically insoluble in polar solvents and the clusters do not develop a stain with all types of solvents.

According to the invention the agglomerating agent is soluble in the products used by forgers to erase the inks, such as hair sprays, household stain removers, gasolines and more generally the products that are found commercially which contain a proportion of solvent in the composition.

Thus the agglomerating agent is preferably soluble both in non-polar solvents and in polar solvents as well as in commercial products containing a proportion of solvent in the composition.

According to the invention the agglomerating agent is advantageously a compound from the family of ethyl celluloses.

Elementary particles agglomerated in an ethyl cellulose matrix which correspond quite well with the aim of the invention are for example those from the MICROLITH®-A range from CIBA, these very coarse clusters, the grain size of which is very heterogeneous, need to be ground and sieved in order to produce cluster sizes suitable for producing papers that cannot be forged according to the invention. Thus, advantageously, these clusters are ground and sieved so as to obtain a grain size of less than 100 μm.

Advantageously according to the invention there is a small proportion of the agglomerating agent in the cluster relative to the pigment particles, depending on the preparation process this proportion can vary from 2-3% to 30-40% by dry weight, the elementary particles always being in the majority in the cluster.

In order that the stain developed is as intense and as rapid as possible, the strongest relationship possible between the elementary particles and the agglomerating agent is sought. In practice the smaller the quantity of agglomerating agent is, the more rapid the dispersion of the elementary particles in the paper is.

According to the invention the elementary particles are coloured pigments and are preferably intense pigment dyestuffs such as those used to produce inks or paints, which pigment dyestuffs are advantageously temperature and light stable.

However, without exceeding the scope of the invention it can be envisaged to use in the clusters pigments that are luminescent, i.e. fluorescent or phosphorescent, or sensitive to infrared rays or anti-Stokes or that contain various authenticatable markers, capable of functioning according to the same principle of diffusion as the pigment dyestuffs when the clusters are broken up. These luminescent pigments can be used in combination with the coloured pigment particles to provide, at the same time as the unforgeable aspect, an authenticatable aspect. In this context, it can be envisaged in particular to combine several different types of pigments in the same clusters so as to obtain agglomerates capable of releasing coloured particles under the action of solvents, but also being able to contain, as is known from other preparation processes, products that can be authenticated under a suitable radiation.

It can be envisaged for example that each individual cluster contains coloured pigment particles, pigments that are fluorescent in short or long wave UV, anti-Stokes pigment particles, and other types of markers comprising properties of complete insolubility in water and solvents. Such clusters have properties of unforgeability with respect to solvents and properties of authenticatability which make them very secure products that can be used for passports in particular, and for documents that both require protection for the personal data with respect to forgeries and have to be authenticated.

Thus advantageously according to the invention the clusters contain, in addition to the coloured pigment particles, different categories of other pigment particles, each individual cluster being able to comprise, alone or in combination, pigment particles that are luminescent under a suitable illumination such as particles that are fluorescent, phosphorescent, anti-Stokes, infrared, opaque to X-rays, DNA markers, and generally markers known for authenticating documents which are insoluble in water and solvents or which can be produced in a form comprising these properties. It can be envisaged for example to place markers in polymer matrices with small sizes, typically of less than 10 μm, which matrices are not sensitive to water or to solvents and can therefore be used for the agglomeration process.

EXAMPLES

The invention, according to an embodiment example, corresponds to a security paper that cannot be forged with respect to non-aqueous solvents comprising in the whole volume of the sheet clusters of less than 100 μm and of more than 50 μm formed of coloured pigment particles with sizes of less than 10 μm amalgamated with an agglomerating agent that is insoluble in water and soluble in polar and non-polar solvents, almost instantaneously, so as to release the coloured particles that produce a stain indicating the forgery, advantageously the agglomerating agent is a compound from the family of ethyl celluloses the proportion of which in the clusters is less than 40% by dry weight, which clusters advantageously correspond to the product MICROLITH® Black C-A from CIBA which have been ground and sieved, or other products from the Microlith® range.

When a solvent, for example toluene or ethanol, is applied to a paper containing 5 kg per tonne of clusters of the product MICROLITH® Black C-A ground and sieved to 100 μm, a black stain immediately appears on the paper, this stain cannot be removed by a prolonged soaking in solvent or by multiple extraction attempts.

The invention also relates to a process for making a paper unforgeable with respect to polar and/or non-polar solvents characterized in that clusters with sizes of less than 500 μm formed of elementary pigment particles with reduced sizes that are insoluble both in water and in solvents, preferably of less than 20 μm, and more preferably still less than 10 μm, amalgamated with an agglomerating agent from the family of ethyl celluloses likewise insoluble in water but almost instantaneously soluble in at least one solvent are introduced into the paper pulp, before production of the sheet.

The clusters according to the invention are introduced into the paper pulp at a rate of 1 to 20 kg per tonne of paper, and preferably of 1 to 5 kg per tonne of paper for clusters with sizes of less than 100 μm and for a dry weight of clusters. For larger clusters, and depending on the desired effect the quantities can increase.

According to the use desired by papermakers and to facilitate the introduction of the clusters into the paper pulp, it can be envisaged to prepare the clusters in aqueous phase and to use them in a dispersed form that is easier to handle in the production of the paper, this embodiment variant does not impact on the unforgeability result of the paper or on the operating method for breaking up the clusters under the effect of a solvent. Owing to their sizes, the clusters are retained well in the paper during the process of dewatering the pulp during the formation of the sheet, whether this involves a Fourdrinier-type table or cylinder mould that can be used to produce passports.

As a variant, although this is not a preferred embodiment, it can be envisaged to deposit the clusters using a coating device, for example a curtain system, or using a printing process, silk screen printing in particular, to carry out a surface treatment of the paper.

In the whole of the above description, the term paper is to be understood as a flexible porous network, advantageously fibrous, that can be printed on and used to produce secure documents, it is preferably a paper that can be produced on a papermaking machine but the term also encompasses non-woven products that can be produced by a non-papermaking route and cardboard-type materials or various fibrous agglomerates The invention will be further described by the following numbered paragraphs:

1. A security paper that cannot be forged with respect to forgery attempts with non-aqueous solvents, comprising on its surface and/or in its bulk, clusters formed of elementary particles amalgamated with an agglomerating agent that is insoluble in water but almost instantaneously soluble in at least one non-aqueous solvent, which agglomerating agent is present in a maximum proportion of 40% by dry weight in the clusters, said elementary particles are coloured pigments and are advantageously intense pigment dyestuffs such as those used for producing inks or paints, said elementary particles are insoluble both in water and in non-aqueous solvents and have sizes of less than 20 μm, and advantageously less than 10 μm.
2. The security paper according to paragraph 1, wherein the clusters have sizes of less than 500 μm and advantageously sizes of less than 200 μm.
3. The security paper according to paragraph 1, wherein the agglomerating agent is soluble in polar solvents such as for example alcohol or acetone.
4. The security paper according to paragraph 1, wherein the agglomerating agent is soluble in non-polar solvents such as for example toluene or hydrocarbons.
5. The security paper according to paragraph 1, wherein the agglomerating agent is soluble in the products used by forgers to erase the inks, such as hair sprays, household stain removers, gasolines and more generally the products that are found commercially which contain a proportion of non-aqueous solvent in the composition.
6. The security paper according to paragraph 1, wherein the agglomerating agent is soluble both in non-polar solvents and in polar solvents as well as in commercial products containing a proportion of non-aqueous solvent in the composition.
7. A security paper that cannot be forged and can be authenticated according to paragraph 1 in which the clusters contain, in addition to the coloured pigment particles, different categories of other pigment particles, each individual cluster being able to comprise, alone or in combination, pigment particles that are luminescent under a suitable illumination such as particles that are fluorescent, phosphorescent, anti-Stokes, infrared, opaque to X-rays, DNA markers, as well as markers known for authenticating documents which are insoluble in water and non-aqueous solvents or which can be produced in a form comprising these properties.
8. The security paper that cannot be forged according to paragraph 1, wherein the agglomerating agent is a compound from the family of ethyl celluloses.
9. A process for making a paper unforgeable with respect to non-aqueous polar and/or non-polar solvents characterized in that clusters with sizes of less than 500 μm formed of elementary particles with reduced sizes that are insoluble both in water and in non-aqueous solvents, of less than 20 μm, and advantageously less than 10 μm, amalgamated with an agglomerating agent from the family of ethyl celluloses likewise insoluble in water but almost instantaneously soluble in at least one non-aqueous solvent, which agglomerating agent is present in a maximum proportion of 40% by dry weight in the clusters, which elementary particles are coloured pigments and are advantageously intense pigment dyestuffs such as those used for producing inks or paints, are introduced into the paper pulp, before production of the sheet.

Of course, the invention is not limited to the embodiments described and represented as examples, but it also comprises all the technical equivalents as well as combinations thereof as variations of the particular embodiments may be made and still fall within the scope of the appended claims.

The invention claimed is:

1. A security paper that cannot be forged with respect to forgery attempts with non-aqueous solvents, comprising on its surface and/or in its bulk, clusters formed of elementary particles amalgamated with an agglomerating agent that is insoluble in water but almost instantaneously soluble in at least one non-aqueous solvent, which agglomerating agent is present in a maximum proportion of 40% by dry weight in the clusters, said elementary particles are coloured pigments, are insoluble both in water and in non-aqueous solvents, and have sizes of less than 20 μm.

2. The security paper according to claim 1, wherein the clusters have sizes of less than 500 μm.

3. The security paper according to claim 1, wherein the agglomerating agent is soluble in at least one polar solvent.

4. The security paper according to claim 1, wherein the agglomerating agent is soluble in at least one non-polar solvent.

5. The security paper according to claim 1, wherein the agglomerating agent is soluble in the products used by forgers to erase the inks.

6. The security paper according to claim 1, wherein the agglomerating agent is soluble in non-polar solvents, in polar solvents and in commercial products containing a proportion of non-aqueous solvent in the composition.

7. A security paper that cannot be forged and can be authenticated according to claim 1 in which the clusters contain, in addition to the coloured pigment particles, different categories of other pigment particles.

8. The security paper that cannot be forged according to claim 1, wherein the agglomerating agent is a compound from the family of ethyl celluloses.

9. A process for making a paper unforgeable with respect to non-aqueous solvents characterized in that clusters formed of elementary particles amalgamated with an agglomerating agent that is insoluble in water but almost instantaneously soluble in at least one non-aqueous solvent, which agglomerating agent is present in a maximum proportion of 40% by dry weight in the clusters, said elementary particles are coloured pigments, are insoluble both in water and in non-aqueous solvents, and have sizes of less than 20 μm, are introduced into the paper pulp before production of the paper, said paper comprising said clusters on its surface and/or in its bulk.

10. The security paper according to claim 1, wherein the colored pigments are intense pigment dyestuffs used for producing inks or paints.

11. The security paper according to claim 1, wherein the elementary particles have sizes less than 10 μm.

12. The security paper according to claim 2, wherein the clusters have sizes less than 200 μm.

13. The security paper according to claim 3, wherein the polar solvent is alcohol or acetone.

14. The security paper according to claim 4 wherein the non-polar solvent is toluene or hydrocarbons.

15. The security paper according to claim 1, wherein the agglomerating agent is soluable in the products that are found commercially which contain a proportion of non-aqueous solvent in the composition.

16. The security paper according to claim 5, wherein the products are hair sprays, household stain removers, and gasoline.

17. The security paper according to claim 7 wherein the other pigment particles are selected from the group consisting of fluorescent, phosphorescent, anti-Stokes, infrared, opaque to X-rays, DNA markers, and markers known for authenticating documents, which are insoluble in water and non-aqueous solvents or which can be produced in a form comprising these properties.

* * * * *